US005525771A

United States Patent [19]

Lund

[11] Patent Number: 5,525,771

[45] Date of Patent: Jun. 11, 1996

[54] SPARK IGNITION SWITCH AND VALVE ASSEMBLY FOR GAS BURNERS INCLUDING EXTERNAL DETENT ASSEMBLY

[75] Inventor: Lyle B. Lund, Geneva, Ill.

[73] Assignee: Harper-Wyman Company, Aurora, Ill.

[21] Appl. No.: 346,904

[22] Filed: Nov. 30, 1994

[51] Int. Cl.[6] ..... H01H 9/06

[52] U.S. Cl. ..... 200/61.86; 431/256

[58] Field of Search ..... 200/61.86, 8 A, 200/11 A, 11 K, 6 B; 431/254–257, 258–266; 74/527–532; 137/560

[56] References Cited

U.S. PATENT DOCUMENTS

| | | | |
|---|---|---|---|
| 3,122,616 | 2/1964 | Rice et al. | 200/61.86 |
| 3,502,835 | 3/1970 | Batcheller | 200/61.86 X |
| 3,912,886 | 10/1975 | Allen et al. | 200/11 K |
| 4,019,855 | 4/1977 | Camillo | 431/256 |
| 4,082,925 | 4/1978 | Hufford | 200/11 G |
| 4,249,047 | 2/1981 | Huff et al. | 200/61.86 |
| 4,626,196 | 12/1986 | Stohrer, Jr. | 431/264 |
| 4,810,188 | 3/1989 | Kwiatek | 431/266 |
| 4,846,671 | 7/1989 | Kwiatek | 431/266 |

*Primary Examiner*—J. R. Scott

*Attorney, Agent, or Firm*—Mason, Kolehmainen, Rathburn & Wyss

[57] ABSTRACT

An improved spark ignition switch and gas valve assembly is provided. A gas valve includes a manually rotatable stem for controlling gas flow rates through the valve. A spark ignition switch includes a first stationary electrical contact; a second electrical contact including an arm for moving the second electrical contact into and out of engagement with the first stationary electrical contact; and a rotor rotatable by the valve stem. The rotor includes a cam moving the arm for moving the electrical contacts into engagement for a predetermined range of rotation of the valve stem and for moving the electrical contacts out of engagement with rotation of the valve stem past the predetermined range. A detent mechanism is operatively arranged with the rotor for providing tactile feedback to a user. The detent mechanism is arranged for engagement at a predefined rotational angle within the predetermined range of rotation of the valve stem.

11 Claims, 4 Drawing Sheets

SPARK IGNITION SWITCH AND VALVE ASSEMBLY FOR GAS BURNERS INCLUDING EXTERNAL DETENT ASSEMBLY

BACKGROUND OF THE INVENTION

1. Field of the Invention

The present invention relates generally to a spark ignition switch and gas valve assembly for gas burners, and more particularly to an improved spark ignition switch for controlling a spark electrode.

2. Description of the Prior Art

Spark ignition typically is used with gas burners. Spark ignition avoids the energy consumption and heat caused by a standing igniter pilot flame that was often used in the past to ignite gas burners, such as gas range top burners. Various arrangements are known in the art for spark ignition of gas burners such as gas stove oven burners, gas stove top burners or a gas barbecue grill burners. Many known arrangements include a high voltage electrode positioned relative to ground member so that a spark will jump between the high voltage electrode and the ground member to ignite the gas when high voltage is applied to the high voltage electrode. Typically the high voltage electrode is positioned by an insulative support member so that an end portion of the electrically conductive wire defining the electrode is located near a grounded burner cap or side-wall.

Examples of spark ignited gas burners are provided by U.S. Pat. Nos. 4,626,196 issued Dec. 2, 1986, 4,810,188 issued Mar. 7, 1989 and 4,846,671 issued Jul. 11, 1989, assigned to the assignee of the present invention.

Various types of ignition circuits are known for use with spark ignited gas burners. Many known ignition circuits use a combined spark ignition switch and gas valve. The gas valves typically utilize rotary control elements such as plugs or discs operable by axially extending rotatable stems. The spark ignition switches typically are secured to or adjacent the valve and include contact operating cams rotatable by the stems. Typically the valve stem is axially movable for unlocking purposes. For example, U.S. Pat. No. 4,249,047 issued Feb. 3, 1981, discloses improved gas valve and spark ignition switch assembly having cooperating coupling structures for efficient assembly.

Problems with many spark ignition switch and gas valve arrangements involve the manual rotation and proper positioning of the stem for reliable operation of the spark ignition switch. It is desirable to provide a spark ignition switch and gas valve arrangement that provides tactile feedback to the user and proper positioning, reliable and repeatable spark ignition operations.

SUMMARY OF THE INVENTION

Among the principal objects of the present invention are to provide an improved spark ignition switch and valve assembly for gas burners; to provide a new and improved spark ignition switch that provides effective and reliable operation; and to provide a spark ignition switch overcoming one or more of the disadvantages of known spark ignition control arrangements.

In brief, the objects and advantages of the present invention are achieved by a spark ignition switch and gas valve assembly. A gas valve includes a manually rotatable stem for controlling gas flow rates through the valve. A spark ignition switch includes a first stationary electrical contact; a second electrical contact including an arm for moving the second electrical contact into and out of engagement with the first stationary electrical contact; and a rotor rotatable by the valve stem. The rotor includes a cam moving the arm for moving the electrical contacts into engagement for a predetermined range of rotation of the valve stem and for moving the electrical contacts out of engagement with rotation of the valve stem past the predetermined range. A detent mechanism is operatively arranged with the rotor for providing tactile feedback to a user. The detent mechanism is arranged for engagement at a predefined rotational angle within the predetermined range of rotation of the valve stem.

BRIEF DESCRIPTION OF THE DRAWING

The present invention, together with the above and other objects and advantages, may best be understood from the following detailed description of the embodiment of the invention illustrated in the drawings, wherein.

DETAILED DESCRIPTION OF THE PREFERRED EMBODIMENT

Figure 1:
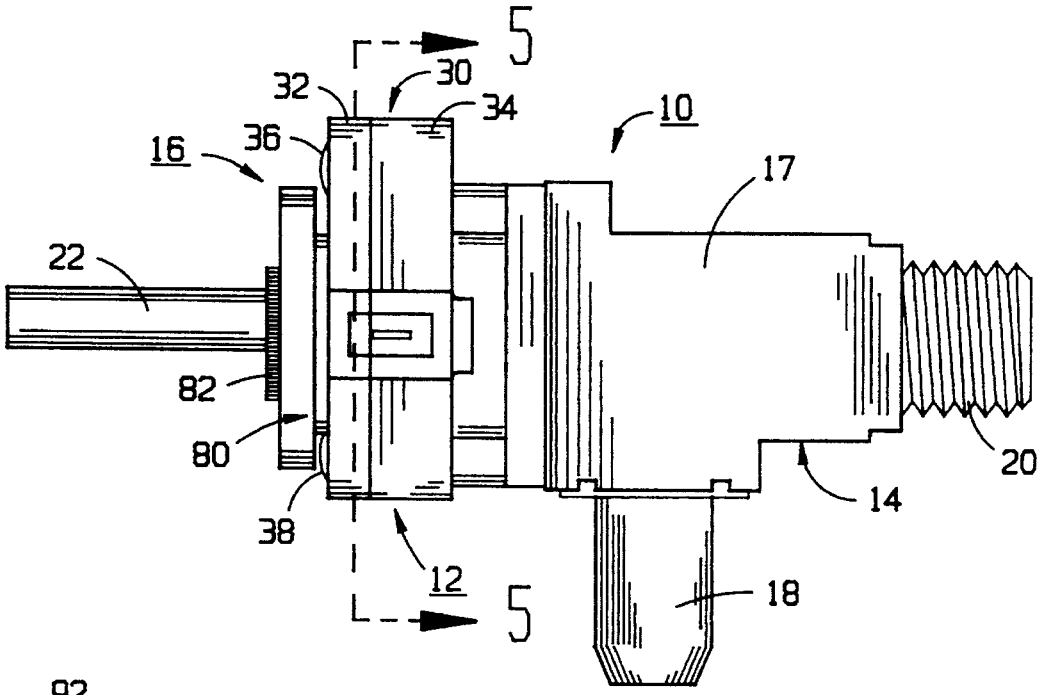
FIG. 1 is a side elevational view of a spark ignition switch and valve assembly constructed in accordance with the principles of the present invention.

Referring now to the drawings, in FIGS. 1–9 there is illustrated a spark ignition switch and valve assembly designated as a whole by the reference character 10 and arranged in accordance with principles of the present invention. Having reference initially to FIGS. 1, 2, 3 and 4, assembly 10 includes a spark ignition switch 12 for enabling spark ignition and a valve 14 for controlling gas supplied to a gas burner (not shown). Spark ignition switch 12 includes a detent mechanism generally designated by the reference character 16 arranged in accordance with the invention. Detent mechanism 16 provides tactile feedback to the user with proper positioning of the spark ignition switching contacts for reliable and repeatable spark ignition operations.

Valve 14 conventionally includes a valve body 17 having a gas inlet 18 and an outlet 20. Gas flow through the valve 14 is controlled by adjustment of a control knob (not shown) from an off or closed position to a wide range of gas flow rates. Valve 14 includes a manually rotatable shaft or stem 22 extending through the spark ignition switch 12 attached to the control knob. Valve stem 22 is push-to-rotate to avoid accidental operation of the spark ignition switch and valve assembly 10. The stem 22 is locked in conventional manner in the off position of the valve 14 and is axially moved inwardly to unlock a flow controlling element (not shown), such as a valve rotor or tapered plug, for rotation to its operative positions.

Figure 2:
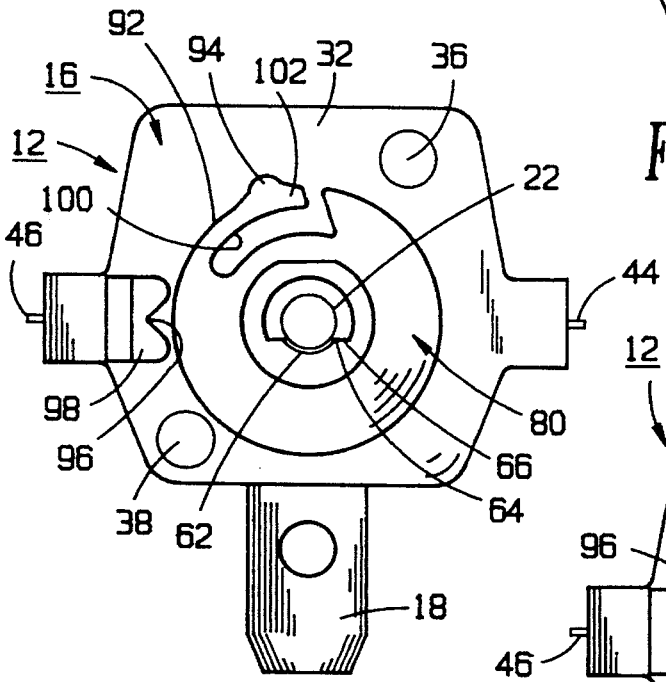
FIG. 2 is a front end elevational view of the spark ignition switch and valve assembly of FIG. 1 illustrating an OFF position.
Figure 3:
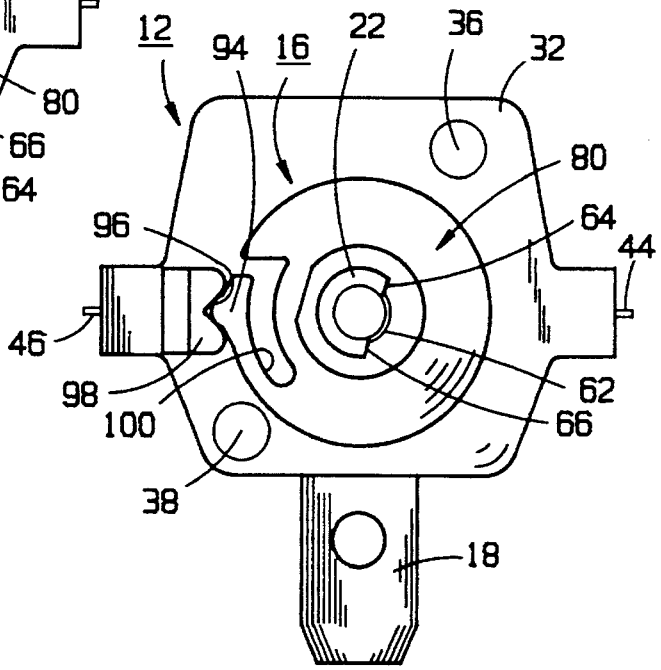
FIG. 3 is a front end elevational view of the spark ignition switch and valve assembly of FIG. 1 illustrating a spark ignition activated or LIGHT position of the assembly.
Figure 4:
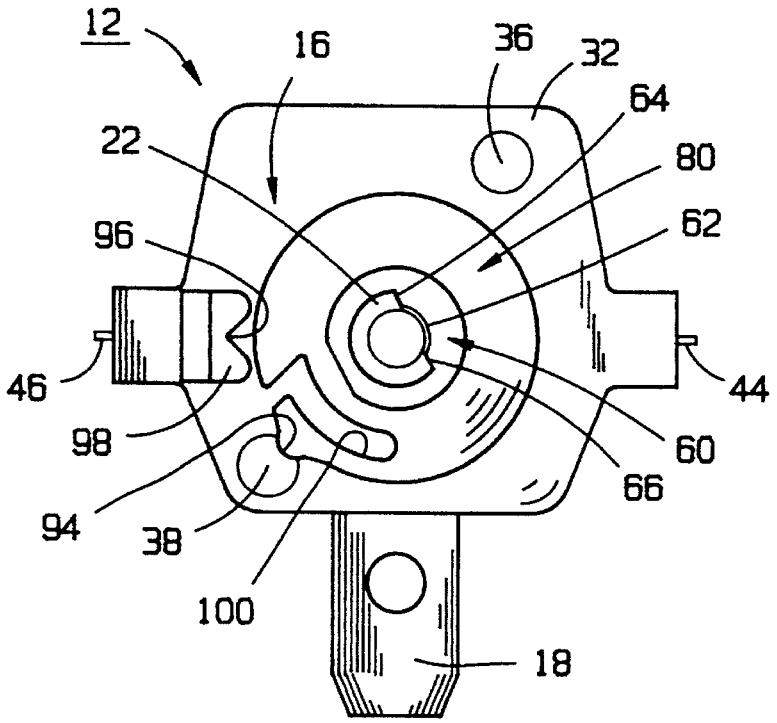
FIG. 4 is a front end elevational view of the spark ignition switch and valve assembly of FIG. 1 illustrating an operating position of the assembly with the spark ignition switch in an off switch position.

A front end elevational view of the spark ignition switch and valve assembly 10 is shown in an off position in FIG. 2 and in a spark ignition activated or LIGHT position in FIG. 3. From the off position of FIG. 2, stem 22 is rotated in a counterclockwise direction approximately 72° to the LIGHT position of FIG. 3 with valve 14 near fully open. After ignition, further manual rotation of the stem 22 in the counterclockwise direction to approximately 90° from the off position provides valve 14 fully open. With further rotation of the stem 22 from 90° to approximately 270° provides reduced gas flow through the valve 14 to effect a desired gas flame adjustment. In FIG. 4, an operating position of the assembly 10 is shown with the stem 22 rotated in the counterclockwise direction to approximately 117° from the off position. In FIG. 4, the spark ignition switch 12 is provided in an off switch position and the detent mechanism 16 is disengaged.

Figure 7:
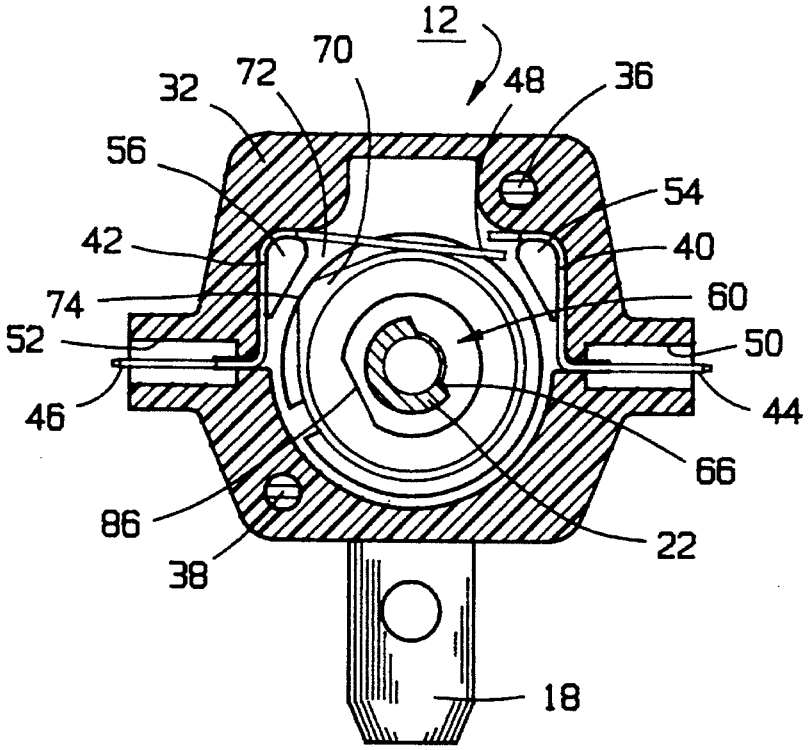
FIG. 7 is a similar view of FIG. 5 illustrating the operating position of the assembly as illustrated in FIG. 4.
Figure 5:
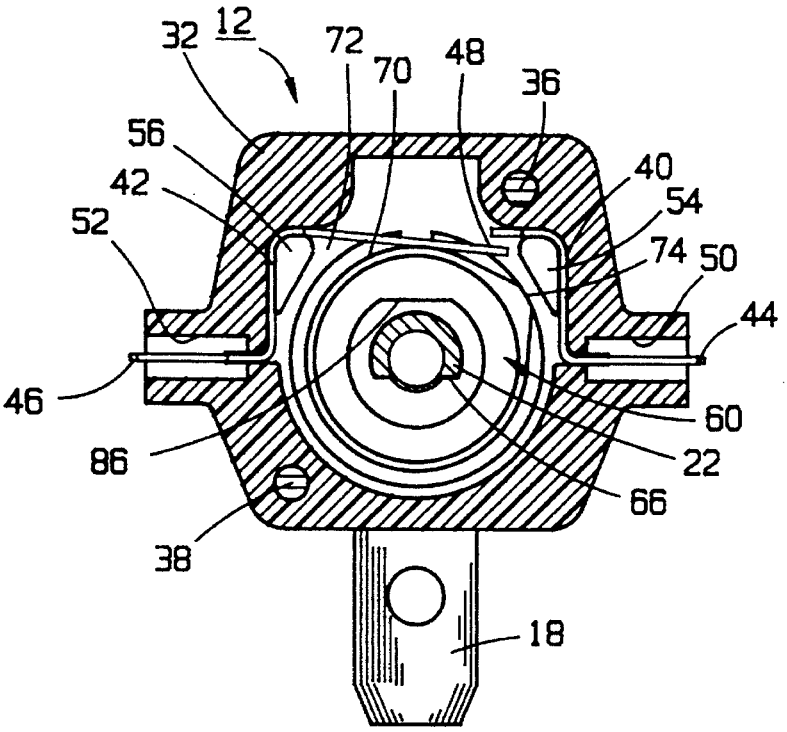
FIG. 5 is a sectional view taken along the line 5—5 of FIG. 1 illustrating an OFF position as illustrated in FIG. 2.
Figure 6:
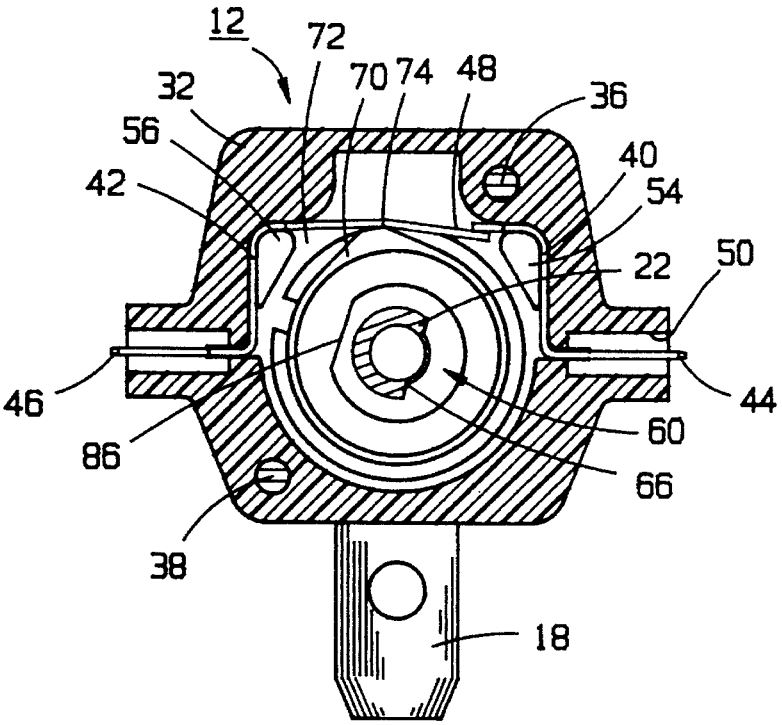
FIG. 6 is similar view of FIG. 5 illustrating the spark ignition activated or LIGHT position of the assembly as illustrated in FIG. 3.

Referring also to FIGS. 5, 6 and 7, spark ignition switch 12 includes an enclosure 30 formed by an outer housing or cover 32 and an inner housing portion or base 34 secured together by fasteners, such as a pair of rivets 36 and 38. Spark ignition switch 12 includes a pair of electrical contacts 40 and 42 with a respective external terminal blade portion 44 and 46 extending outside the housing base 34 for electrical connection to a spark electrode circuitry (not shown). Electrical contact 40 is a stationary contact and electrical contact 42 includes a movable free end 48 for opening and closing an electrical path between the electrical contacts 40 and 42 to control the on-off condition of the spark electrode circuit. Housing base 34 includes a pair of aligned apertures 50 and 52 formed in the opposed side walls for receiving the switch terminal blade contact portions 44 and 46. Housing base 34 includes a pair of molded ledges or protrusions 54 and 56 spaced from the opposed side walls defining channels for accurately positioning the pair of electrical contacts 40 and 42 within housing 30.

Figure 8:
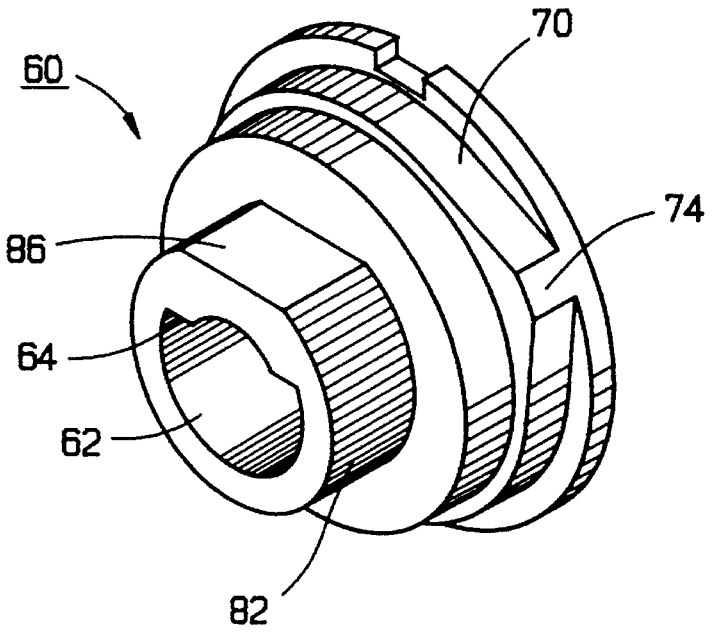
FIG. 8 is an enlarged perspective view of a rotor of the spark ignition switch of FIG. 1.
Figure 9:
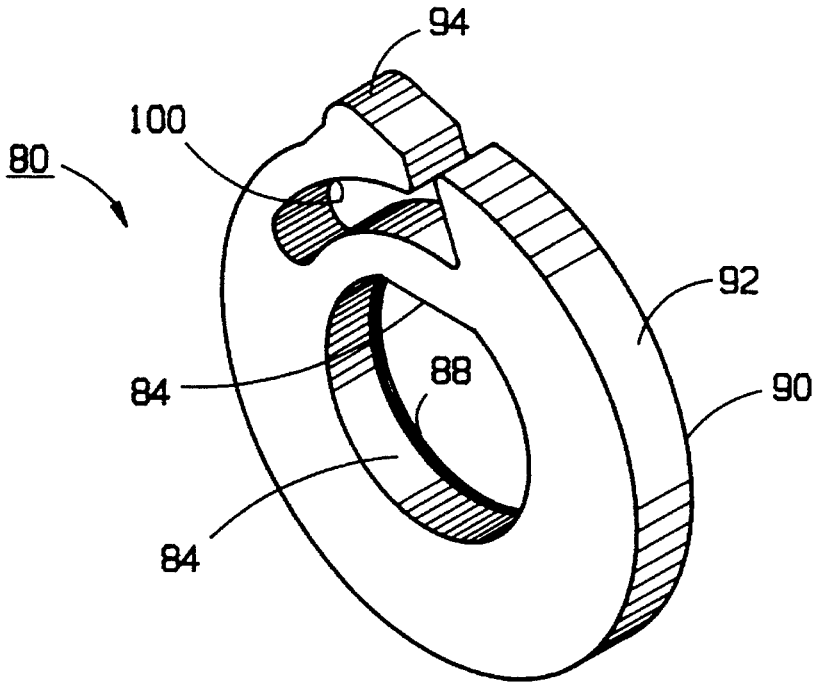
FIG. 9 is an enlarged perspective view of a detent member of the spark ignition switch of FIG. 1.

Referring to FIG. 8, there is shown a cam or rotor generally designated by 60 of the spark ignition switch 12. Having reference also to FIGS. 5, 6 and 7, rotor 60 is mounted on the valve stem 22 for corresponding rotation with the stem 22 responsive to the manual rotation of the control knob. A central aperture 62 of rotor 60 includes flat portion 64 mating with a valve stem flat 66 of the generally D-shaped stem 22 for positioning the rotor 60. Rotor 60 includes a switch contact operating cam 70 received within a cavity 72 of the base 34 for ignition switch operation. Cam 70 provides a peripheral cam surface 74 in operative engagement with the movable switch contact arm 48 for controlling the on-off switch position corresponding to a user selected spark ignition position, as shown in FIG. 6. Switch contact arm 48 is moved into electrical engagement with the stationary switch contact 40 in a predetermined range of rotation of stem 22, for example, in a range from approximately 35° to 80°.

Referring now to FIGS. 2, 3, 4, 8 and 9, detent mechanism 16 includes a detent member generally designated by 80 mounted on a forward extension 82 of the rotor 60 exterior of the housing cover 32 for operative rotation with the rotor 60 which corresponds to rotation of the valve stem 22. Detent member 80 has a generally central aperture 84 including a flat portion 84 mating with a corresponding flat 86 of rotor extension 82 for positioning the detent member 80. A tapered portion or chamfer 88 of the aperture 84 formed in an inside wall 90 of detent member 80 facilitates mounting the detent member 80 on rotor extension 82, for example by press fit engagement. A detent abutment 94 formed on a peripheral surface 92 of the detent member 80 is received within a cooperating detent notch 96 defined by a post 98 formed on housing cover 32 in the LIGHT position of the spark ignition switch and valve assembly 10. An elongated slot 100 in detent member 80 defines a finger 102 supporting detent abutment 94 and increases flexibility for cooperatively positioning the detent abutment 94 into the detent notch 96.

Detent member 80 is formed of an electrically insulative material having sufficient strength and resiliency, such as a natural nylon, type 6/6 material. Rotor 60 is formed of an electrically insulative material having sufficient strength, rigidity and temperature rating, such as a thermoplastic meeting an operating temperature of 130° C.

Briefly reviewing the operation of the spark ignition switch and valve assembly 10, when valve 14 is operated to an open position, gas is supplied from its outlet to the gas burner. Spark ignition switch 12 is operated from an off switch position to an on switch position with the valve stem 22 rotated in a range between approximately 35° and 80° to enable spark ignition of the gas. Detent mechanism 16 is engaged and provides the user with tactile feedback of the spark ignition or LIGHT position with the valve stem 22 rotated to a predefined rotational angle, such as approximately 72°. With further rotation of the valve stem 22 past the predefined rotational angle, detent mechanism 16 is disengaged as shown in FIG. 4. With further rotation of the valve stem 22 past approximately 80°, spark ignition switch 12 is operated from the on switch position to the off switch position, as shown in FIGS. 4 and 7.

While the invention has been described with reference to details of the illustrated embodiment, these details are not intended to limit the scope of the invention as defined in the appended claims.

What is claimed is:

1. A spark ignition switch and valve assembly comprising:

a gas valve including a manually rotatable stem for controlling gas flow rates through said gas valve;

a spark ignition switch including a first stationary electrical contact;

a second electrical contact including an arm for moving the second electrical contact into and out of engagement with the first stationary electrical contact;

a rotor rotatable by said valve stem, said rotor including a cam for moving said arm for moving the electrical contacts into engagement for a predetermined range of rotation of said valve stem and for moving the electrical contacts out of engagement with rotation of said valve stem past said predetermined range; and detent means operatively arranged with said rotor for providing tactile feedback to a user; said detent means arranged for engagement at a predefined rotational angle within said predetermined range of rotation of said valve stem.

2. A spark ignition switch and valve assembly as recited in claim 1 wherein said detent means include a first detent member operatively rotatable by said spark ignition switch rotor and a cooperating stationary detent for engaging said first detent member at said predefined rotational angle.

3. A spark ignition switch and valve assembly as recited in claim 2 wherein said spark ignition switch includes an enclosure; said first detent member is mounted on said rotor exterior of said enclosure and said cooperating stationary detent is formed on said enclosure.

4. A spark ignition switch and valve assembly as recited in claim 3 wherein said enclosure includes a base and a cover, each formed of a synthetic plastic material.

5. A spark ignition switch and valve assembly as recited in claim 2 wherein said first detent member and said spark ignition switch rotor include cooperating keying surfaces for positioning said first detent member.

6. A spark ignition switch and valve assembly as recited in claim 2 wherein said rotatable detent member includes an elongated slot for decreasing the rigidity of said detent member.

7. A spark ignition switch and valve assembly as recited in claim 3 wherein said stationary detent member is formed by molding of said enclosure cover.

8. A spark ignition switch and valve assembly as recited in claim 2 wherein said first detent member is formed of an electrically insulative material.

9. A spark ignition switch and valve assembly as recited in claim 2 wherein said first detent member is formed of nylon.

10. A spark ignition switch and valve assembly as recited in claim 1 wherein said predetermined range of rotation includes a range of said valve stem rotation from an off position of said gas valve of approximately 35° and 80°.

11. A spark ignition switch and valve assembly as recited in claim 10 wherein said predefined rotational angle is approximately 72°.

* * * * *